US006012371A

United States Patent [19]

Nishigaki

[11] Patent Number: 6,012,371

[45] Date of Patent: Jan. 11, 2000

[54] SHEET CUTTING DEVICE

[75] Inventor: Hideo Nishigaki, Nagoya, Japan

[73] Assignee: Brother Kyogo Kabushiki Kaisha, Nagoya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/826,737

[22] Filed: Apr. 4, 1997

[30] Foreign Application Priority Data

Apr. 12, 1996 [JP] Japan ..... 8-091017

[51] Int. Cl.[7] ..... B26D 1/38

[52] U.S. Cl. ..... 83/611; 83/349; 83/698.11; 83/597

[58] Field of Search ..... 83/349, 596, 611, 83/658, 673, 694, 698.11, 698.31, 610, 612, 341, 597, 583, 579, 332

[56] References Cited

U.S. PATENT DOCUMENTS

| | | | |
|---|---|---|---|
| 1,632,378 | 6/1927 | Lerner | 83/349 X |
| 1,738,076 | 12/1929 | Molins | 83/349 X |
| 3,522,752 | 8/1970 | Ford | 83/611 |
| 3,769,868 | 11/1973 | Hornung | 83/349 |
| 3,855,891 | 12/1974 | Young | 83/611 X |
| 3,918,339 | 11/1975 | Cailloux | 83/611 |
| 4,244,251 | 1/1981 | Iwao et al. | 83/349 |
| 5,001,952 | 3/1991 | Myogadani | 83/349 X |
| 5,359,915 | 11/1994 | Hitz | 83/349 X |
| 5,377,572 | 1/1995 | Sonobe et al. | 83/611 X |

FOREIGN PATENT DOCUMENTS

| | | | |
|---|---|---|---|
| 288246 | 3/1913 | Germany | 83/673 |
| 197028 | 9/1957 | Germany | 83/694 |
| 64110 | 3/1937 | Norway | 83/596 |

*Primary Examiner*—Rinaldi I. Rada
*Assistant Examiner*—Boyer Ashley
*Attorney, Agent, or Firm*—Oliff & Berridge, PLC

[57] ABSTRACT

A cutting device including: a support member; a first blade having a linear-shaped cutting edge extending in a lengthwise direction from a first lengthwise end, to a central portion, and to a second lengthwise end of the first blade, the first blade being supported by the support member; and a second blade having a linear-shaped cutting edge extending from a first lengthwise end to a central portion, and to a second lengthwise end of the second blade, the second blade being supported in confrontation with the first blade by the support member, the first blade and the second blade cutting therebetween a sheet-shaped medium by serially contacting each other from the first lengthwise ends to the second lengthwise ends while the second blade presses against the first blade in a thickness direction of the first blade; wherein at least one of the first and second blades has a smaller deformation resistance, with respect to the support member, in its blade thickness direction at its first and second lengthwise ends than at its central portion.

40 Claims, 4 Drawing Sheets

SHEET CUTTING DEVICE

BACKGROUND OF THE INVENTION

1. Field of the Invention

The present invention relates to a cutting device used to cut sheet-shaped objects, such as documents or elongated thermal paper used for recording transmitted massages in a facsimile machine.

2. Description of the Related Art

FIG. 1 shows an example of a conventional cutting device. The conventional cutting device shown in FIG. 1 includes: a frame 101E; a fixed blade 102E having a linear cutting edge 122 and fixedly attached to the frame 101E; a pair of side shafts 130C, 130D; and a movable blade 103E having a linear cutting edge 132. The movable blade 103E is supported at end portions 103*c*, 103*d* thereof by the support shafts 130*c*, 130*d* respectively so that the movable blade 103E is disposed slightly in intersection with the fixed blade 102E. The fixed blade 102E is formed from a uniformly thick metal plate, for example, bent into a substantially L shape in cross section so that the lower edge of the fixed blade 102E is integrally linked with the support member 121E. The support member 121E uniformly supports all positions in the lengthwise direction of the lower edge of the fixed blade 102E.

The movable blade 103E is rotatable in a vertical direction indicated by an arrow N1 and is freely movable toward and away from the fixed blade 102E accordingly. Also, rotational center line of the movable blade 103E is slanted in a vertical direction with respect to the fixed blade 102E by an appropriate angle θ. It should be noted that the appropriate angle θ is shown exaggeratedly large in FIG. 1 in order to facilitate its understanding.

With this configuration, when the movable blade 103E is rotated downward so as to move closer to the fixed blade 102E, the cutting edge 132 of the movable blade 103E presses against the fixed blade 102E in the blade thickness direction, indicated by an arrow N2, at portions following the lengthwise direction of the fixed blade 102E from the end 102*c* to the other end 102*d*. In this type of cutting device, cutting operation of the cutting edges 122 and 132 cuts across the width of elongated sheets supplied between the fixed blade 102E and the movable blade 103E.

In order to appropriately cut the sheet using this type of cutting device, it is necessary that the fixed blade 102E and the movable blade 103E uniformly contact each other along the lengthwise edges of the cutting edges 122, 132. In order to ensure that the fixed blade 102E and the movable blade 103E contact each other uniformly at all positions in the lengthwise direction, it is necessary to position the fixed blade 102E and the movable blade 103E with extreme accuracy so that they slightly intersect each other and their the cutting edges 122, 132 appropriately contact each other.

SUMMARY OF THE INVENTION

However, when the fixed blade 102E is attached at a slant so that the lengthwise end portion 102*c* of the fixed blade 102E is slightly closer to the movable blade 103E than is the lengthwise end portion 102*d*, then contact pressure developed when the movable blade contacts the lengthwise tip portion 102*c* will be extremely high so that it is difficult to smoothly operate movement of the movable blade 103E. As a result, the positioning of the fixed blade 102E and the movable blade 103E must be adjusted with great accuracy. Because this requires troublesome adjustment operations, production of the cutting device is poor.

Additionally, when the movable blade 103E contacts the fixed blade 102E, the movable blade 103E bends in opposition to this contact. When the flexible blade 103E is supported at its lengthwise ends 103*c*, 103*d* by the support shafts 130C, 130D, then the movable blade 103E will bend more at its central portion in the lengthwise direction than at the end portions 103*c*, 103*d*. For this reason, even if the fixed blade 102E and the movable blade 103E are set to intersect each other accurately enough to ensure they contact each other, contact pressure will vary at different positions in the lengthwise direction. That is, contact pressure generated at the center portions of the movable blade 103E and the fixed blade 103E will differ from contact pressure generated when the lengthwise end portions 103*c*, 103*d* of the movable blade 103E contact the lengthwise end portions 102*c*, 102*d* of the fixed blade 102E. Said differently, pressure generated when the lengthwise tip portions of the movable blade 103E and the fixed blade 102E contact each other is much greater than contact pressure generated when the lengthwise center portions contact each other.

Therefore, this conventional configuration has limitations as to how smooth contact can be between the fixed blade 102E and the movable blade 103E. For this reason, operations for adjusting contact between the fixed blade 102E and the movable blade 103E to an appropriate level are very difficult. If the fixed blade 102E and the movable blade 103E are adjusted so that their lengthwise central portions contact each other in an appropriate manner, then an overly large contact pressure will be generated between the movable blade 103E and the fixed blade 102E when the movable blade 103E contacts the lengthwise end portions 102*c*, 102*d* of the fixed blade 102E. As a result, the torque required to move the movable blade 103E also increases greatly. Accordingly, the drive motor for driving the movable blade 103E must be a large and powerful motor.

It is an objective of the present invention to overcome the above-described problems and to provide a cutting device having a simple configuration enabling a pair of blades to contact each other at a uniform contact pressure along their lengths, the simple configuration enabling simple adjustment of contact between the blades so that a small drive motor is sufficient for moving the movable blade.

In order to achieve the above-described objectives, a cutting device according to the present invention includes: a support member; a first blade having a linear cutting edge extending in a lengthwise direction from a first lengthwise end to a central portion, and to a second lengthwise end of the first blade, the first blade being supported by the support member; and a second blade having a linear cutting edge extending from a first lengthwise end to a central portion, and to a second lengthwise end of the second blade, the second blade being supported in confrontation with the first blade by the support member, the first blade and the second blade cutting therebetween a sheet medium by serially contacting each other from the first lengthwise ends to the second lengthwise ends while the second blade presses against the first blade in a thickness direction of the first blade; wherein at least one of the first and second blades has a smaller deformation resistance, with respect to the support member, in its blade thickness direction at its first and second lengthwise ends than at its central portion.

With this configuration, when the lengthwise ends of the blades come in contact with each other, at least one of the blades deforms easily in a direction away from the other blade at the end portion so that only a small contact pressure develops between the blades. Accordingly, only a low pressure is developed between the lengthwise end portions of the blades when they contact each other. Also, the low pressure developed when the end portions contact each other is substantially equal to that developed when the lengthwise central portions of the blades contact each other. The object to be cut can therefore be cut precisely.

Also, in contrast to the conventional device described above, only a small contact pressure will develop between the two blades even when they are installed so that the their lengthwise end portions contact each other more strongly than their central portions. As a result, the movable blade can be more smoothly moved. The blades need not be precisely installed so that positioning of the blades can be performed more easily. Further, there is no need to provide a drive source with a large torque for moving the movable blade. The drive motor can be small and inexpensive.

According to another aspect of the present invention, the at least one of the first and second blades is supported only at its lengthwise central portion. In this way, the cutting device has a simple configuration and so is inexpensive to produce.

According to another aspect of the present invention, the at least one of the first and second blades is formed from a metal plate having an approximately L shape in cross section. Cutout portions are formed at predetermined positions in the metal plate. With this configuration, the cutting device has a simple configuration and so is inexpensive to produce.

According to still another aspect of the present invention, indentation portions instead of cut-out portions can be formed in the metal plate of the at least one of the first and second blades. With this configuration also, the cutting device has a simple configuration and is inexpensive to produce.

According to another aspect of the present invention, not only the lengthwise end portions but also the lengthwise central portion of the at least one of the first and second blades is easily deformable in the blade thickness direction so that only a small contact pressure develops when the lengthwise central portions of the blades contact each other. With this configuration, overall contact pressure developed between the blades can be reduced so that operations of the blades can be performed more smoothly.

According to a still further aspect of the present invention, at least one of the blades is formed with a different thickness along its length so that the objectives of the present invention can be achieved using a simple and inexpensive configuration.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
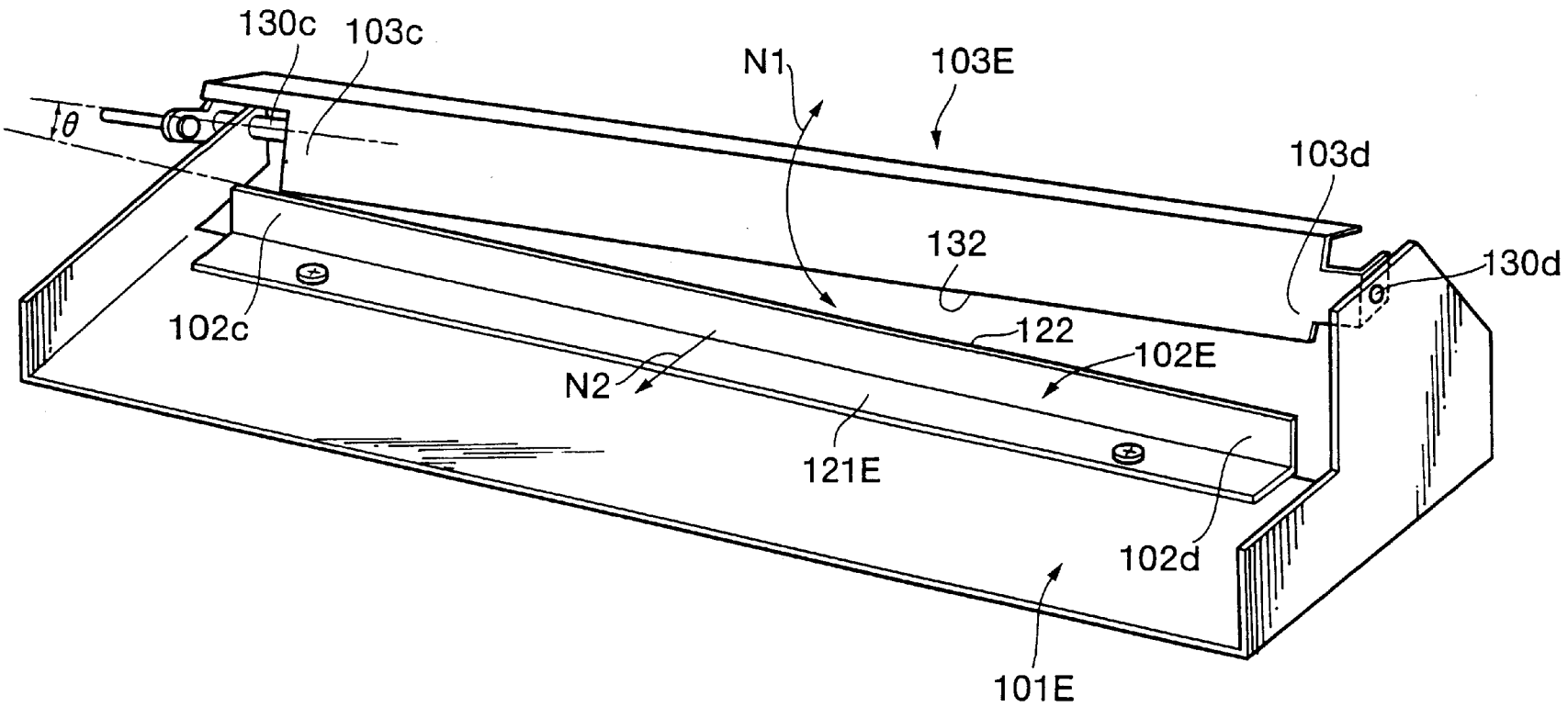
FIG.1 RELATED ART
FIG. 1 is a perspective view showing a conventional cutting device.

A cutting device according to preferred embodiments of the present invention will be described while referring to the accompanying drawings wherein like parts and components are designated by the same reference numerals to avoid duplicating description.

Figure 2:
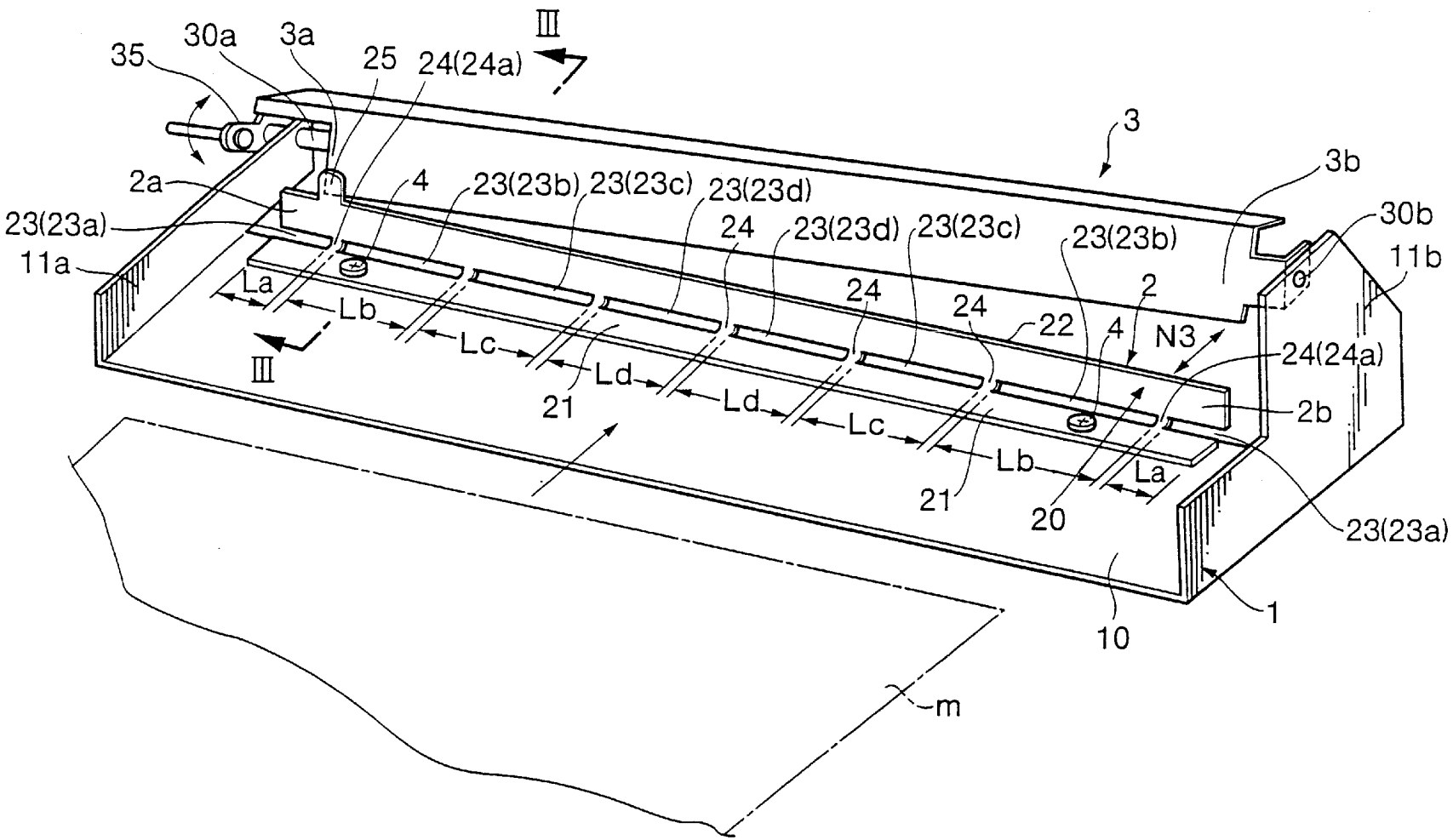
FIG. 2 is a perspective view showing a cutting device according to an embodiment of the present invention.
Figure 3:
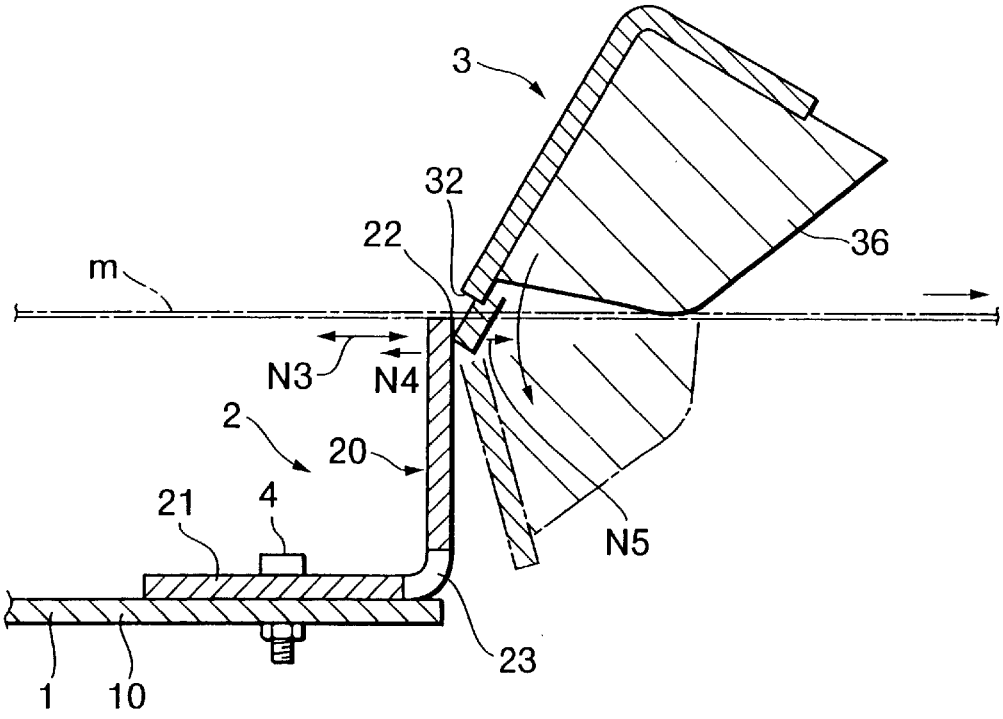
FIG. 3 is a cross-sectional view taken along a line III-III' of FIG. 2 showing the cutting device of FIG. 2 in a condition before cutting a sheet (solid lines) and in a condition after cutting a sheet (dot-chain line)

FIG. 2 is a perspective view showing a cutting device according to the first embodiment. FIG. 3 is a magnified cross-sectional view taken along line II-II' of FIG. 2. The cutting device shown in FIG. 2 is used assembled in a facsimile machine. The cutting device is used to cut a sheet m into predetermined lengthwise dimensions. The sheet m is an elongated recording sheet disposed on a role and is used in a facsimile machine to print image data using a printer portion. The cutting device includes: a frame 1 formed from a thin metal plate bent using press machining techniques; and a pair of blades 2, 3 mounted on the frame 1. The blade 2 is a fixed blade and the blade 3 is a movable blade.

As shown in FIG. 3, the fixed blade 2 is formed from a piece of metal plate having a fixed thickness. The metal plate is bent into an approximately L shape in cross section forming a crook portion where a cutting-edge wing 20 of the metal plate confronts a base wing 21 of the metal plate. In other words, the base wing 21 and cutting-edge wing 20 are formed integrally together from the same metal plate. The cutting-edge wing 20 forms the fixed blade 2. The base wing 21 supports the fixed blade 2. A cutting edge 22 is formed by a corner portion at the uppermost edge of the cutting-edge wing 20. The cutting edge 22 need not be formed in an acute angle, but could have a blade tip having a 90° angle and still be able to reliably cut recording sheets used in a facsimile machine. As will be described later, the cutting edge 32 of the movable blade 3 is formed in the same manner.

The frame 1 includes: a substantially horizontal base plate portion 10; and two side portions 11*a* and 11*b* provided with an upright posture to opposite ends of the base plate portion 10. The base wing 21 is fixedly attached to the base plate portion 10 by screws 4 so as to be disposed above and substantially in parallel with the base plate portion 10. As a result, the fixed blade 2 is fixedly attached with its cutting-edge wing 20 extending upward from one edge of the base wing 21.

As shown in FIG. 2, a small rib portion 25 with an upright posture is provided at the upper edge of the cutting-edge wing 20 at a lengthwise end portion 2*a* of the fixed blade 2. The small rib portion 25 serves to guide the movable blade 3 along one side of the fixed blade 2 to ensure that the cutting edge 32 of the movable blade 3 does not cross over the other side of the fixed blade 2 when the movable blade 3 is moved into contact with the fixed blade 2.

A plurality of slit-shaped cutout portions 23*a* through 23*d* are formed intermittently following the lengthwise direction of the fixed blade 2 at the crook portion between the lower edge of the cutting-edge wing 20 and the base wing 21. Hereinafter, the cutout portions 23*a* through 23*d* will be referred to collectively as the cutout portions 23 unless otherwise noted. The contact portions 23 are defined by a plurality of narrow support portions 24 between adjacent members of the cutout portions 23. With this configuration, the plurality of support portions 24 support the fixed blade 2 on the base wing 21.

Of the cutout portions 23, endmost cutout portions 23*a*, 23*a* are formed at the crook portion between the base wing 21 and the lengthwise end portions 2*a*, 2*b* of the fixed blade 2. The cutout portions 23*a*, 23*a* are formed in an open ended slit shape having an appropriate length La. With this configuration, the lengthwise end portions 2*a*, 2*b* of the fixed blade 2 are positioned above the cutout portions 23*a*, 23*b* and so are supported from below only at one end by one of the support portions 24*a*. As a result, the lengthwise end portions 2*a*, 2*b* deform with comparative ease in the blade thickness direction indicated by an arrow N3 in FIG. 2.

At each position in the lengthwise central portion of the fixed blade 2, each position is supported at both ends by the plurality of support portions 24 including support portions 24*a*. Because the lengthwise central portions of the fixed blade 2 are supported at both ends in this manner, the central portion has a greater resistance to deformation in the blade thickness direction with respect to the base wing 21, and therefore deforms less readily in the blade thickness direction than do the lengthwise end portions 2*a*, 2*b* of the fixed blade 2.

The plurality of cutout portions 23 other than the cutout portions 23*a*, 23*a*, that is, the cutout portions 23*b* through 23*d*, are formed to different lengths Lb through Ld. The lengths Lb through Ld increase with increasing proximity to the lengthwise end portions 23*a*, 23*a* of the fixed blade 2. This relationship between the distances Lb through Ld can be described using following formula:

$$Lb>Lc>Ld.$$

Accordingly, at the lengthwise central portion of the fixed blade 2, resistance against deformation in the blade thickness direction with respect to the base wing 21 becomes increasingly smaller with proximity to the lengthwise end portions 23*a*, 23*a*. In other words, the fixed blade 2 deforms with greater ease in the blade thickness direction at portions near to the lengthwise end portions 23*a*, 23*a* than at portions near the central portion. The length of the cutout portions 23*b* through 23*d* can be alternatively set to meet requirements of the following equation:

$$Lb>Lc=Ld.$$

The movable blade 3 is formed using press machining techniques to bend a metal plate having fixed thickness into a substantially L shape in cross section. A linear cutting edge 32 is formed by a lower corner portion of the movable blade 3. Support shafts 30*a*, 30*b* attached to the lengthwise tips of the movable blade 3 support the movable blade 3 so as to be rotatably supported on the side plates 11*a*, 11*b* of the frame 1. The support shafts 30*a*, 30*b* support the movable blade 3 is in confrontation with the fixed blade 2 at a position slightly downstream from the fixed blade 2, with respect to a sheet-feed direction of the sheet m, so they slightly intersect each other. The support shaft 30*b* is disposed at a position above the support shaft 30*a* so that the movable blade 3 slants at an angle with respect to the fixed blade 2. The angle of slant between the movable blade 3 and the fixed blade 2 is shown exaggerated in FIG. 2 to facilitate its understanding. Because the movable blade 3 is supported at its tip portions by the support shafts 30*a*, 30*b*, the movable blade 3 is more easily deformable in its blade thickness direction at its lengthwise central portion than at its end portions.

An arm 35 is connected to the support shaft 30*a*. Although not shown in the drawings, a motor is provided to supply drive force to the arm 35. Drive force transmitted from the motor to the arm 35 operates to freely pivot the movable blade 3 upward and downward around the support shafts 30*a*, 30*b*. Because the rotational center of the movable blade 3, as determined by the arrangement of the support shafts 30*a*, 30*b*, is slanted at an appropriate angle downward with respect to the fixed blade 2, when the movable blade 3 rotates downward around the support shafts 30*a*, 30*b* and approaches the cutting edge of the fixed blade 2, then, first, the lengthwise end portion 3*a* of the movable blade 3 contacts the lengthwise end portion 2*a* of the fixed blade 2 and, subsequently, the cutting edges 22 and 32 serially contact each other at positions along the lengthwise direction, until, finally, the lengthwise end portion 3*b* of the movable blade 3 contacts the lengthwise end portions 3*b* of the fixed blade 2.

As shown in FIG. 3, a supplemental member 36 formed from compound resin, for example, is provided to the lower surface side of the movable blade 3. After the sheet m has been cut, the supplemental member 36 serves to press the end edge of the cut sheet m in the sheet-feed direction.

Next, the operations of the cutting device will be explained. The condition of the movable blade 3 when disposed above the fixed blade 2 before a cutting operation is indicated by solid lines in FIG. 3. As indicated by two-dot chain lines in FIG. 3, when a sheet m passes between the fixed blade 2 and the movable blade 3, the movable blade 3 is driven to pivot downward at a predetermined timing. As a result of this, the cutting edge 32 of the movable blade 3 and the cutting edge 22 of the fixed blade 2 come into mutual contact, thereby cutting the sheet m therebetween.

When the sheet m is being cut, it is necessary that the cutting edge 32 of the movable blade 3 contacts the cutting edge 22 of the fixed blade 2 with an appropriate force. The portion of the fixed blade 2 abutted by the cutting edge 32 of the movable blade 3 is deformed by pressure from the movable blade 3 so as to deform in the direction indicated by an arrow N4 in FIG. 3. In opposition to this, the movable blade 3 will deform to move in a direction indicated by an arrow N5 in FIG. 3.

As a result of deformation of blades 2,3, the following actions occur. Because the lengthwise center portion of the fixed blade 2 has a greater resistance to deformation in the blade thickness direction than do the lengthwise end portions 2*a*, 2*b*, the center portion of the fixed blade 2 does not greatly deform during cutting operations. In contrast to this, when contacted by the fixed blade 2, the lengthwise central portion of the movable blade 3 bends with greater ease than the lengthwise end portions 3*a*, 3*b*. As a result, only a small pressure is developed when the lengthwise center portions of the fixed blade 2 and movable blade 3 come in contact with each other during cutting operations.

Also, the lengthwise end portions 3*a*, 3*b* of the movable blade 3 deform to bend only a small amount when contacted by the lengthwise end portions 2*a*, 2*b* of the fixed blade 2. In contrast to this, the lengthwise end portions 2*a*, 2*b* of the fixed blade 2 have only a small resistance to deformation in the blade thickness direction with respect to the base wing 21. Therefore, when the lengthwise end portions 2*a*, 2*b* contact the movable blade 3, the lengthwise end portions 2*a*, 2*b* can easily deform away from the movable blade 3. Accordingly, only a small pressure is developed when the lengthwise end portions 2*a*, 2*b* of the fixed blade 2 contact the lengthwise end portions 3*a*, 3*b* of the movable blade 3.

As a result, a large contact pressure can be prevented from being generated between the fixed blade 2 and the movable blade 3 at any point contact therebetween. Moreover, the cutting edge 32 of the movable blade 3 can be serially brought into contact with the cutting edge 22 of the fixed blade 2 at a uniform contact pressure at all positions along the length of the cutting edges 22, 32.

Because the fixed blade 2 is formed with a plurality of cutout portions 23 in the lengthwise central portion thereof, it easily deforms in the blade thickness direction. Therefore, overall contact pressure developed between the fixed blade 2 and the movable blade 3 when these two contact each other can be reduced. Because the movable blade 3 is supported only at its lengthwise tip portions, the amount that it deformingly bends will increase with proximity to its lengthwise tip portions. In contrast of this, because the lengthwise center portion of the fixed blade 2 is formed with a plurality of cutout portions 23 having different lengths Lb to Ld, the fixed blade 2 deforms more easily in the blade thickness direction with increasing proximity to the lengthwise end portions 2*a*, 2*b*. As a result, contact pressure between the fixed blade 2 and the movable blade 3 can be more uniform.

In the cutting device with this configuration, the movable blade 3 can be operated more smoothly and the sheet m can be cut more precisely to a clean cut edge. Even when the fixed blade 2 is fixed to the frame 1 in an imprecise manner so that the lengthwise end portion 2*a* of the fixed blade 2 is attached closer to the movable blade 3 than is the lengthwise end portion 2*b*, movement of the movable blade 3 will be smooth because only a small contact pressure is generated between the lengthwise end portion 2*a* of the fixed blade 2 and lengthwise end portion 3*a* of the movable blade 3. Accordingly, positioning of the fixed blade 2 and of the movable blade 3 can be easily adjusted. Further, only a small force need be provided to operate the movable blade 3.

While the invention has been described in detail with reference to specific embodiments thereof, it would be apparent to those skilled in the art that various changes and modifications may be made therein without departing from the spirit of the invention, the scope of which is defined by the attached claims.

Figure 4:
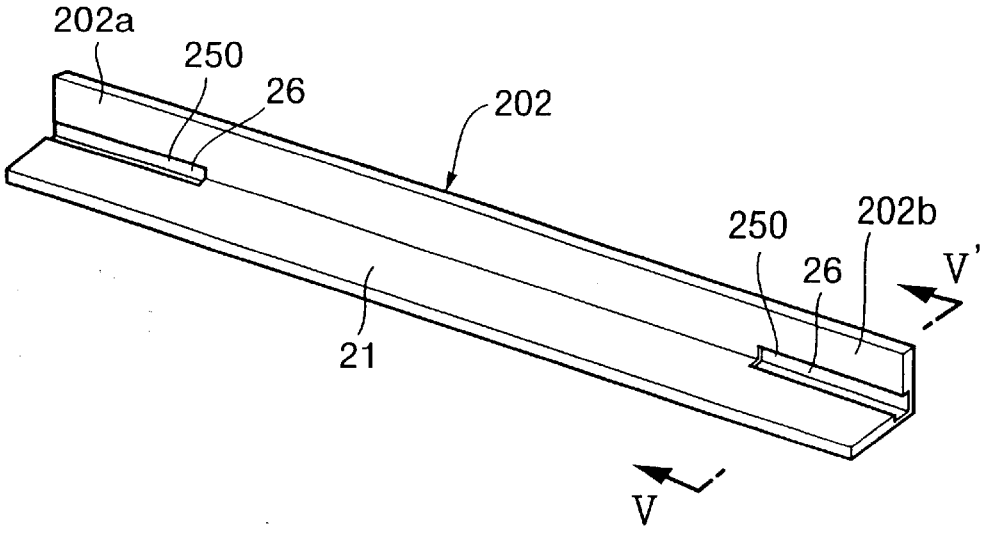
FIG. 4 is a perspective view showing a second embodiment of the present invention.
Figure 5:
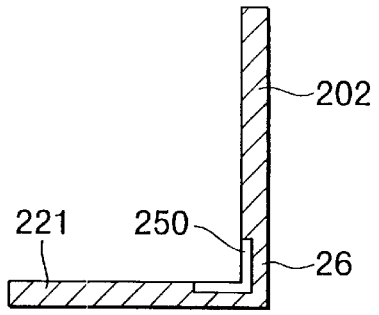
FIG. 5 is a cross-sectional view taken along line V-V' of FIG. 4.
Figure 6:
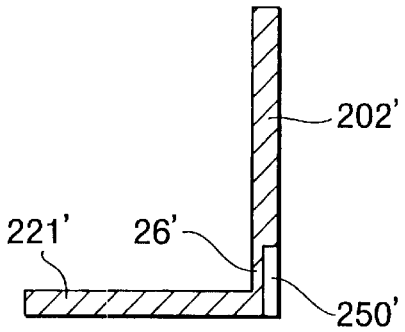
FIG. 6 is cross-sectional view showing a modification of the second embodiment.

For example, in the first embodiment, slit-shaped cutout portions 23*a* are provided at the crook portion between the lengthwise end portions 2*a*, 2*b* and the base wing 21. However in a second embodiment shown in FIGS. 4 and 5, instead of the cutout portions 23*a*, indentation portions 250 can be formed in the crook portion at lengthwise end portions 202*a*, 202*b* of an L-shaped fixed blade 202. The indentation portions 250 form thin portions 26, which are thinner than the lengthwise center portion of the fixed blade 202. When such a thin portion 26 is provided, the lengthwise end portions 202*a*, 202*b* of the fixed blade 202 can be easily deformed in the blade thickness direction. Although FIG. 4 shows the indentation portions 250 formed in an interior surface at the crook portion, that is, where the cutting-edge wing and the base wing form a 90° angle, instead, as shown in FIG. 6, indentation portions 250' could be formed in an exterior surface at the crook portion, that is, where a cutting-edge wing 202' and a base wing 221' form a 270° angle. In the modification shown in FIG. 6, thin portions 26' are formed to the opposite side of a fixed blade 202' than are the indentation portions 250'.

Figure 7:
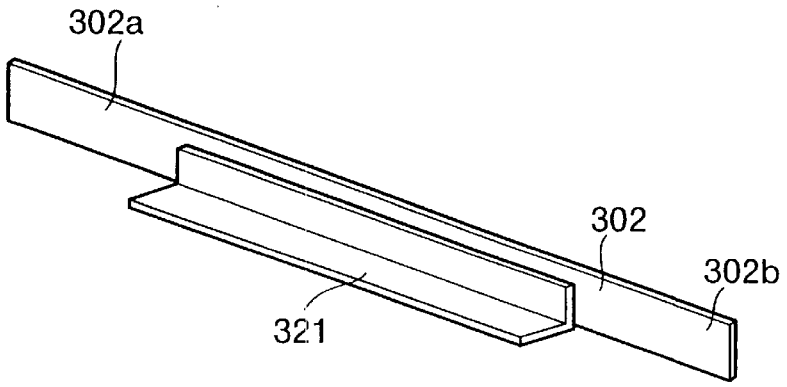
FIG. 7 is a perspective view showing a third embodiment of the present invention.

It is not necessary to integrally form the cutting-edge wing 20 and the base wings 21 from a metal plate having a substantially L shape in cross section. As shown in FIG. 7, a fixed blade 302 formed from a thin plate can be attached to a support portion 321 formed from a plate having a substantially L shape in cross section. In this case, the support portion 321 is disposed to support only the lengthwise central portion of the fixed blade 302 and not lengthwise end portions 302*a*, 302*b*. In this case also, the lengthwise end portions 302*a*, 302*b* of the fixed blade 302 are more easily deformed in the blade thickness direction than is the lengthwise central portion, which is supported by the support portion 321.

Figure 8:
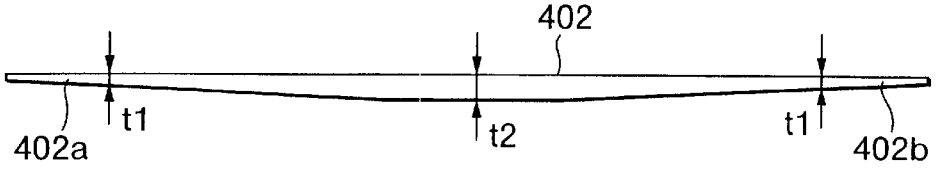
FIG. 8 is a cross-sectional view showing a fourth embodiment of the present invention.

Further, as shown in FIG. 8, a fixed blade 402 can be provided wherein its thickness t1 at its lengthwise end portions 402*a*, 402*b* is thinner than its thickness t2 at its lengthwise center portion. In this case, the fixed blade 402 can be formed in a tapered shape as shown in FIG. 8, wherein thickness of the fixed blade 402 changes in a continuous manner or, alternatively, the thickness of the lengthwise end portions only can be formed thinner than other portions of the fixed blade. The thickness of the fixed blade can also be formed thinner in incrementations from thickest at the central portion to thinnest at the end portions. With any of the above-described configurations, the lengthwise end portions of the fixed blade bend more easily in the blade thickness direction than does the lengthwise central portion so that the objectives of the present invention are achieved.

Although the lengthwise end portions 2*a*, 2*b* of the fixed blade 2 are described in the first embodiment as being more easily deformed than is the lengthwise central portion, the configurations described for the fixed blade can be applied to the movable blade so that the lengthwise end portions of the movable blade have a smaller resistance to deformation in the thickness direction, with respect to the support portion supporting the movable blade, than does the lengthwise central portion of the movable blade. As a further alternative, both the fixed blade and the movable blade can be formed so that their respective lengthwise end portions deform more easily than do their respective lengthwise central portions.

Further, the cutting device according to the present invention can be used in devices other than a facsimile machine and can be used for cutting sheet-shaped objects other than a recording sheet of a facsimile machine.

What is claimed is:

1. A cutting device, comprising:

a support member;

a first blade having a linear cutting edge extending in a lengthwise direction from a first lengthwise end to a central portion, and to a second lengthwise end of the first blade, the first blade being supported by the support member and having a thickness extending in a thickness direction perpendicular to the lengthwise direction; and a second blade having a linear cutting edge extending from a first lengthwise end to a central portion, and to a second lengthwise end of the second blade, the second blade being supported in a facially opposing relationship with the first blade by the support member and having a thickness extending in the thickness direction, the first blade and the second blade cutting therebetween a sheet medium by serially contacting each other from the first lengthwise ends to the second lengthwise ends while the second blade presses against the first blade in the thickness direction of the first blade;

at least one of the first and second blades comprising a plate having a cutting-edge wing, the at least one of the first and second blades having cut-out portions in the cutting-edge wing, the cut-out portions creating a lower rigidity at the first and second lengthwise ends than at the central portion of the at least one of the first and second blades, whereby the at least one of the first and second blades deforms less in the thickness direction at the central portion than at the first and second lengthwise ends as the first and second blades cut the sheet medium.

2. A cutting device as claimed in claim 1, wherein the support member supports only the central portion of the at least one of the first and second blades.

3. A cutting device as claimed in claim 1, wherein the cutting edge of the at least one of the first and second blades has a protruding rib portion at the first lengthwise end that guides another of the at least one of the first and second blades along a predetermined side of the at least one of the first and second blades.

4. A cutting device as claimed in claim 1, wherein the cutting edge of the at least one of the first and second blades comprises a corner portion having a 90° angle.

5. A cutting device as claimed in claim 1, further comprising a supplemental member provided to another of the at least one of the first and second blades that presses a cut edge of the sheet medium away from the first and second blades while the first and second blades serially contact each other from the first lengthwise ends to the second lengthwise ends.

6. The cutting device as claimed in claim 1, wherein the first blade is fixedly supported by the support member and the second blade is movably supported by the support member, the first and second lengthwise ends of the first blade having the lower rigidity relative to the central portion of the first blade, whereby the first blade deforms less in the thickness direction at the central portion than at the first and second lengthwise ends as the second blade pressingly moves relative to the first blade for cutting the sheet medium.

7. A cutting device as claimed in claim 1, wherein:

the at least one of the first and second blades comprises a piece of metal plate having the cutting-edge wing and a base wing connected to each other at a crook portion, the at least one of the first and second blades having a substantial L-shape in cross section, the cutting-edge wing defining the cutting edge of the at least one of the first and second blades; and the support member includes a support plate portion comprising another piece of metal plate extending substantially parallel to the base wing.

8. A cutting device as claimed in claim 7, wherein the at least one of the first and second blades has the cut-out portions in the cutting-edge wing at its first and second lengthwise ends adjacent where the cutting-edge wing contacts the base wing.

9. A cutting device as claimed in claim 8, wherein the at least one of the first and second blades has another cut-out portion in the cutting-edge wing at its central portion adjacent where the cutting-edge wing contacts the base wing.

10. A cutting device as claimed in claim 9, wherein the at least one of the first and second blades has a plurality of cut-out portions in the cutting-edge wing at its central portion, each of the plurality of cut-out portions having a different length in the lengthwise direction, the lengths of the plurality of cut-out portions increasing with proximity of corresponding cut-out portion to the first and second lengthwise ends of the at least one of the first and second blades.

11. A cutting device comprising:

a support member;

a first blade having a linear-shaped cutting edge, the first blade being supported by the support member; and a second blade having a linear-shaped cutting edge, the second blade being supported in confrontation with the first blade by the support member, the first blade and the second blade cutting therebetween a sheet-shaped medium by contacting each other, at least one of the first and second blades having at least one thickness-reduced portion in a cutting edge wing of the at least one of the first and second blades, the at least one thickness-reduced portion creating a smaller deformation resistance at first and second lengthwise ends of the at least one of the first and second blades than at near a center of the at least one of the first and second blades.

12. A cutting device as claimed in claim 11, wherein the at least one of the first and second blades is formed thicker at its central portion than at its first and second lengthwise ends, whereby the first and second lengthwise ends are the at least one thickness-reduced portion.

13. A cutting device as claimed in claim 12, wherein the at least one of the first and second blades has a tapering thickness which gradually tapers from a thickest portion at its central portion to a thinnest portion at its first and second lengthwise ends.

14. A cutting device as claimed in claim 12, wherein the at least one of the first and second blades has a thickness that diminishes in at least one increment from a thickest portion at its central portion to a thinnest portion at its first and second lengthwise ends.

15. A cutting device as claimed in claim 11, wherein the at least one of the first and second blades comprises a base wing connected to the cutting edge wing at a crook portion to form a substantial L-shape in cross section, the cutting edge wing forming the cutting edge of the at least one of the first and second blades, and wherein the at least one thickness-reduced portion comprises indentation portions in the crook portion at its first and second lengthwise ends, the indentation portions forming thin portions that create the smaller deformation resistance at the first and second lengthwise ends of the at least one of the first and second blades.

16. A cutting device as claimed in claim 15, wherein the at least one of the first and second blades has with another thin portion in the cutting-edge wing at its central portion where the cutting-edge wing confronts the base wing.

17. A cutting device as claimed in claim 15, wherein the at least one of the first and second blades has an interior surface and an exterior surface at opposites facing sides of the crook portion, the indentation portions located in the interior surface at the crook portion.

18. A cutting device as claimed in claim 15, wherein the at least one of the first and second blades has an interior surface and an exterior surface at opposites facing sides of the crook portion, the indentation portions located in the exterior surface at the crook portion.

19. A cutting device comprising:

a support member;

a first blade having a linear-shaped cutting edge, the first blade being supported by the support member; and a second blade having a linear-shaped cutting edge, the second blade being supported in confrontation with the first blade by the support member, the first blade and the second blade cutting therebetween a sheet-shaped medium by contacting each other, at least one of the first and second blades having a plurality of cut-out portions in a cutting edge wing of the at least one of the first and second blades, the cut-out portions creating a smaller deformation resistance at first and second lengthwise ends than at near a center of the at least one of the first and second blades.

20. A cutting device comprising:

a support member;

a first blade having a linear-shaped cutting edge, the first blade being supported by the support member, the cutting edge of the first blade extending in a lengthwise direction from a first lengthwise end to a central portion, and to a second lengthwise end of the first blade; and a second blade having a linear-shaped cutting edge, the second blade being supported in confrontation with the first blade by the support member, the first blade and the second blade cutting therebetween a sheet-shaped medium by contacting each other, the cutting edge of the second blade extending in a lengthwise direction from a first lengthwise end to a central portion, and to a second lengthwise end of the second blade, at least one of the first and second blades having at least one cut-out portion comprising a hole near the first lengthwise end, a hole near the central portion, and a hole near the second lengthwise end, the holes being aligned in the lengthwise direction in which a corresponding cutting edge extends, a length of at least one of the holes in the first and second lengthwise ends being longer than a length of the hole in the central portion, with respect to the lengthwise direction in which the corresponding cutting edge extends.

21. The cutting device as claimed in claim 20, wherein the first blade and the second blade cut therebetween a sheet-shaped medium by serial contact with each other that starts from the first lengthwise ends and that ends at the second lengthwise ends while the second blade presses against the first blade in a thickness direction perpendicular to the lengthwise direction.

22. The cutting device as claimed in claim 20, wherein the at least one of the first and second blades has a cutting-edge wing and a base wing connected to the cutting edge wing to form a substantial L-shape in cross-section, the cutting-edge wing forming the cutting edge of the at least one of the first and second blades, the cut-out portions being aligned along a boundary between the cutting-edge wing and the base wing.

23. The cutting device as claimed in claim 20, wherein the first blade is fixedly supported by the support member and the second blade is movably supported by the support member, the holes being provided in the first blade.

24. The cutting device as claimed in claim 20, further comprising a notch formed in at least one of the first lengthwise end and the second lengthwise end of the at least one of the first blade and the second blade, the notch being aligned with the holes in the lengthwise direction and having an open end opening to the at least one of first lengthwise end and the second lengthwise end of the at least one of the first blade and the second blade.

25. A cutting device comprising:

a support member;

a first blade having a linear-shaped cutting edge, the first blade being supported by the support member, the cutting edge of the first blade extending in a lengthwise direction from a first lengthwise end to a central portion, and to a second lengthwise end of the first blade; and a second blade having a linear-shaped cutting edge, the second blade being supported in confrontation with the first blade by the support member, the cutting edge of the second blade extending in a lengthwise direction from a first lengthwise end to a central portion, and to a second lengthwise end of the second blade, the first blade and the second blade cutting therebetween a sheet-shaped medium by serial contact with each other that starts from the first lengthwise ends and that ends at the second lengthwise ends while the second blade presses against the first blade in a thickness direction perpendicular to the lengthwise direction, at least one of the first and second blades having at least one cut-out portion comprising a hole near the first lengthwise end and a hole near the central portion, the holes being aligned in the lengthwise direction in which a corresponding cutting edge extends, a length of the hole near the first lengthwise end being longer than a length of the hole near the central portion, with respect to the lengthwise direction in which the corresponding cutting edge extends.

26. A cutting device comprising:

a support member;

a first blade having a linear-shaped cutting edge, the first blade being supported by the support member; and a second blade having a linear-shaped cutting edge, the second blade being supported in confrontation with the first blade by the support member, the first blade and the second blade cutting therebetween a sheet-shaped medium by contacting each other, at least one of the first and second blades having at least one cut-out portion comprising a plurality of holes, wherein the cutting edge of the first blade extends in a lengthwise direction from a first lengthwise end to a central portion, and to a second lengthwise end of the first blade, the cutting edge of the second blade extending in a lengthwise direction from a first lengthwise end to a central portion, and to a second lengthwise end of the second blade, and further comprising a plurality of non-cut-out portions each provided between neighboring holes, the holes being aligned in the lengthwise direction in which a corresponding cutting edge extends, the holes and the non-cut-out portions each having a length in the lengthwise direction in which the corresponding blade edge extends, a ratio of a length of a hole to a length of a neighboring non-cut-out portion being larger in the first lengthwise end and in the second lengthwise end than in the central portion.

27. The cutting device as claimed in claim 26, wherein the first blade and the second blade cut therebetween a sheet-shaped medium by serial contact with each other that starts from the first lengthwise ends and that ends at the second lengthwise ends while the second blade presses against the first blade in a thickness direction perpendicular to the lengthwise direction.

28. The cutting device as claimed in claim 26, wherein the at least one of the first and second blades has a cutting-edge wing and a base wing connected to the cutting-edge wing to form a substantial L-shape in cross-section, the cutting-edge wing forming the cutting edge of the at least one of the first and second blades, the cut-out portions being aligned along a boundary between the cutting-edge wing and the base wing.

29. The cutting device as claimed in claim 26, wherein the first blade is fixedly supported by the support member and the second blade is movably supported by the support member, the plurality of holes and the plurality of non-cut-out portions being provided in the first blade.

30. A cutting device comprising:

a support member;

a first blade having a linear-shaped cutting edge, the first blade being supported by the support member, the cutting edge of the first blade extending in a lengthwise direction from a first lengthwise end to a central portion, and to a second lengthwise end of the first blade; and a second blade having a linear-shaped cutting edge, the second blade being supported in confrontation with the first blade by the support member, the first blade and the second blade cutting therebetween a sheet-shaped medium by contacting each other, the cutting edge of the second blade extending in a lengthwise direction from a first lengthwise end to a central portion, and to a second lengthwise end of the second blade, at least one of the first and second blades having at least one thickness-reduced portion comprising a thickness-reduced portion in the first lengthwise end, a thickness-reduced portion in the central portion, and a thickness-reduced portion in the second lengthwise end, the thickness-reduced portions being aligned in the lengthwise direction in which a corresponding cutting edge extends, a length of at least one of the thickness-reduced portions in the first and second lengthwise ends being longer than a length of the thickness-reduced portion in the central portion, with respect to the lengthwise direction in which the corresponding cutting edge extends.

31. The cutting device as claimed in claim 30, wherein the first blade and the second blade cut therebetween a sheet-shaped medium by serial contact with each other that starts from the first lengthwise ends and that ends at the second lengthwise ends while the second blade presses against the first blade in a thickness direction perpendicular to the lengthwise direction.

32. The cutting device as claimed in claim 30, wherein the at least one of the first and second blades has a cutting-edge wing and a base wing connected to the cutting edge wing to form a substantial L-shape in cross-section, the cutting-edge wing forming the cutting edge of the at least one of the first and second blades, the thickness-reduced portions being aligned along a boundary between the cutting-edge wing and the base wing.

33. The cutting device as claimed in claim 30, wherein the first blade is fixedly supported by the support member and the second blade is movably supported by the support member, the thickness-reduced portions being provided in the first blade.

34. A cutting device comprising:

a support member;

a first blade having a linear-shaped cutting edge, the first blade being supported by the support member, the cutting edge of the first blade extending in a lengthwise direction from a first lengthwise end to a central portion, and to a second lengthwise end of the first blade; and a second blade having a linear-shaped cutting edge, the second blade being supported in confrontation with the first blade by the support member, the cutting edge of the second blade extending in a lengthwise direction from a first lengthwise end to a central portion, and to a second lengthwise end of the second blade, the first blade and the second blade cutting therebetween a sheet-shaped medium by serial contact with each other that starts from the first lengthwise ends and that ends at the second lengthwise ends while the second blade presses against the first blade in a thickness direction perpendicular to the lengthwise direction, at least one of the first and second blades having at least one thickness-reduced portion comprising a thickness-reduced portion in the first lengthwise end and a thickness-reduced portion in the central portion, the thickness-reduced portions being aligned in the lengthwise direction in which a corresponding cutting edge extends, a length of the thickness-reduced portion in the first lengthwise end being longer than a length of the thickness-reduced portion in the central portion, with respect to the lengthwise direction in which the corresponding cutting edge extends.

35. A cutting device comprising:

a support member;

a first blade having a linear-shaped cutting edge, the first blade being supported by the support member; and a second blade having a linear-shaped cutting edge, the second blade being supported in confrontation with the first blade by the support member, the first blade and the second blade cutting therebetween a sheet-shaped medium by contacting each other, at least one of the first and second blades having a plurality of thickness-reduced portions, the cutting edge of the first blade extending in a lengthwise direction from a first lengthwise end to a central portion, and to a second lengthwise end of the first blade, the cutting edge of the second blade extending in a lengthwise direction from a first lengthwise end to a central portion, and to a second lengthwise end of the second blade, and further comprising a plurality of non-thickness-reduced portions each provided between neighboring thickness-reduced portions, the thickness-reduced portions being aligned in the lengthwise direction in which a corresponding cutting edge extends, the thickness-reduced portions and the non-thickness-reduced portions each having a length in the lengthwise direction in which the corresponding blade edge extends, a ratio of a length of a thickness-reduced portion to a length of a neighboring non-thickness-reduced portion being larger in the first lengthwise end and in the second lengthwise end than in the central portion.

36. The cutting device as claimed in claim 35, wherein the first blade and the second blade cut therebetween a sheet-shaped medium by serial contact with each other that starts from the first lengthwise ends and that ends at the second lengthwise ends while the second blade presses against the first blade in a thickness direction perpendicular to the lengthwise direction.

37. The cutting device as claimed in claim 35, wherein the at least one of the first and second blades has a cutting-edge wing and a base wing connected to the cutting-edge wing to form a substantial L-shape in cross-section, the cutting-edge wing forming the cutting edge of the at least one of the first and second blades, the thickness-reduced portions being aligned along a boundary between the cutting-edge wing and the base wing.

38. The cutting device as claimed in claim 35, wherein the first blade is fixedly supported by the support member and the second blade is movably supported by the support member, the thickness-reduced portions and the non-thickness-reduced portions being provided in the first blade.

39. A cutting device comprising:

a support member;

a first blade having a linear-shaped cutting edge, the first blade being supported by the support member; and a second blade having a linear-shaped cutting edge, the second blade being supported in confrontation with the first blade by the support member, the first blade and the second blade cutting therebetween a sheet-shaped medium by contacting each other, at least one of the first and second blades having a cutting-edge wing and a base wing, the cutting-edge wing forming the cutting edge of the at least one of the first and second blades, the base wing being connected to the support member, lengthwise edges of the cutting-edge wing and the base wing extending along a length of the at least one of the first and second blades, the lengthwise edge of the base wing being in partial connection with the lengthwise edge of the cutting edge wing by a plurality of connection portions that are separated from each other in a lengthwise direction of the at least one of the first and second blades, first ones of said connection portions, which are located where the at least one of the first and second blades is to have a smaller deformation resistance, being separated by a greater distance than second ones of said connection portions, which are located where the at least one of the first and second blades is to have a larger deformation resistance.

40. The cutting device as claimed in claim 39, wherein the connection portions that are nearer lengthwise ends of the at least one of the first and second blades are separated by a greater distance than connection portions nearer the center of the at least one of the first and second blades, thereby generating a smaller deformation resistance nearer the lengthwise ends than near the center of the at least one of the first and second blades.

* * * * *